United States Patent [19]

Daringer

[11] 4,440,367

[45] Apr. 3, 1984

[54] BARRIER-TYPE METAL WIRE FABRIC AND ITS MANUFACTURE

[75] Inventor: Ronald G. Daringer, Cambridge, Md.

[73] Assignee: Maryland Wire Belts, Inc., Church Creek, Md.

[21] Appl. No.: 503,413

[22] Filed: Jun. 13, 1983

Related U.S. Application Data

[62] Division of Ser. No. 227,666, Jan. 23, 1981, Pat. No. 4,396,041.

[51] Int. Cl.[3] ..... B21F 27/00

[52] U.S. Cl. ..... 245/6; 55/525; 72/139; 72/142

[58] Field of Search ..... 140/3 R, 3 A, 25, 92.4, 140/84; 72/142, 144; 198/848, 849; 139/425 A, 425 R; 55/525; 245/5, 6, 11

[56] References Cited

U.S. PATENT DOCUMENTS

| | | | |
|---|---|---|---|
| 1,735,788 | 11/1929 | Pink | 245/6 |
| 2,498,211 | 2/1950 | Kreisler | 140/92.4 |
| 3,202,387 | 8/1965 | Andrews et al. | 245/6 |
| 3,308,856 | 3/1967 | Ploss | 140/71 R |
| 3,658,099 | 4/1972 | Daringer | 139/425 |

OTHER PUBLICATIONS

*Industrial Heating,* Oct. 1980, p. 58, Wiremation Industries Advertisement Showing Compound Weave Wire Mesh Furnace Curtain.

*Primary Examiner*—Lowell A. Larson
*Assistant Examiner*—Linda McLaughlin
*Attorney, Agent, or Firm*—Raymond N. Baker

[57] ABSTRACT

A barrier-type metal wire fabric which is substantially free of transverse passages while providing desired travel path flexibility is disclosed along with methods and means for its manufacture. Shaped wire with at least two diametrically opposed planar surfaces is helically wound with a planar surface confronting the working surface of the winding mandrel. Left-hand wound and right-hand wound spirals are assembled with individual loop portions of each being nested within the loops of its next adjacent oppositely-wound spiral. A connector rod inserted within longitudinally overlapping internal loop portions of such spirals provides for pivotal relative movement between adjacent spirals and desired travel path flexibility while the dimensional relationships and assembly taught substantially eliminate non-rotational relative movement between metal wire elements of the fabric.

11 Claims, 8 Drawing Figures

FIG. 1
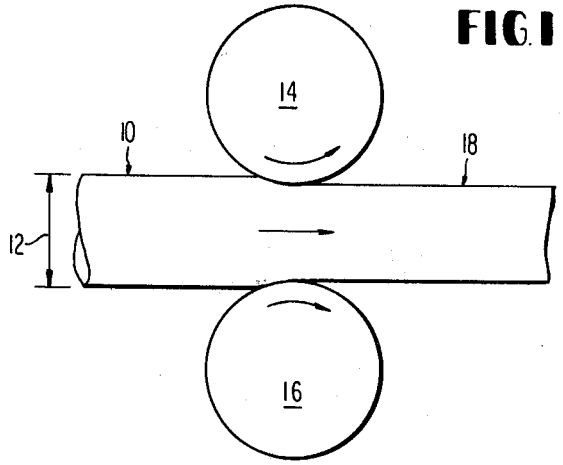
FIG. 2
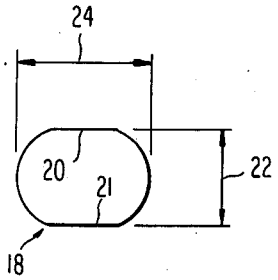
FIG. 4
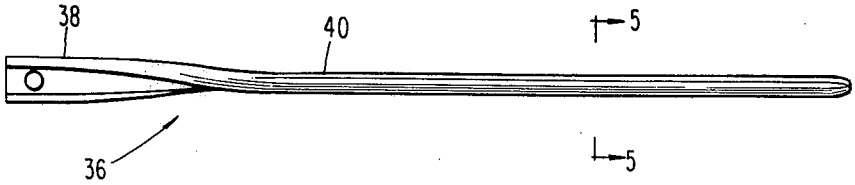
FIG. 5
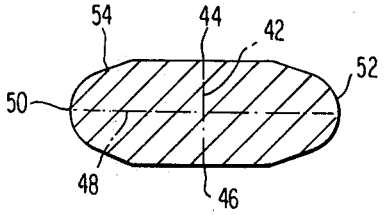
FIG. 3
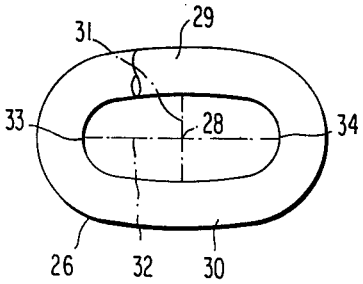
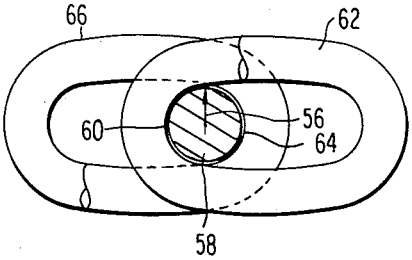
FIG. 6

BARRIER-TYPE METAL WIRE FABRIC AND ITS MANUFACTURE

This is a division, of application Ser. No. 227,666, filed Jan. 23, 1981 now U.S. Pat. No. 4,396,041 (Aug. 2, 1983), the entire disclosure of which is incorporated herein by reference.

This invention is concerned with wire fabric and its manufacture; in particular, with metal wire fabric which is substantially impervious to transverse passage of material while providing other characteristics desired for particular applications of wire fabrics.

Industrial uses for a barrier-type wire fabric have been increasing. For example, in desulphurization or gasification treatment of coal there is a need for a high-strength wire belt which can flex from a longitudinally directed travel path and which has the ability to carry pulverized coal through high temperature treatment chambers. Also, curtain walls at the entrance and exit portions of treatment chambers should be flexible to facilitate ingress and egress of conveyances or work-pieces while otherwise inhibiting escape of chamber atmosphere or influx of ambient atmosphere.

The prior art approach to this need for substantially impervious metal wire fabric has been a compound weave in which multiple spiral wires are closely stacked and joined by two or more connecting rods; this in effect comprises two, three, four or five belts in one. Such an approach can result in a sacrifice of desired flexibility and, because of a tendency to use small gage wire for various reasons, leads to other problems during usage.

The present teachings provide for manufacture of metal wire fabric in which transverse passages are substantially eliminated while maintaining a high degree of longitudinally-directed travel path flexibility. The present teachings also enable use of relatively heavy gage wire as desired without sacrifice of barrier characteristics and, provide non-stretch characteristics while providing good load stability and tracking characteristics when used as belting.

In the present invention, the spiral wire and connecting rod gages are selected to provide the desired substantially-solid barrier effect while particular combinations are provided which facilitate assembly. The metal wire for the spiral components is shaped prior to helical winding. The helical winding and assembly with connecting rods, as taught, obstruct substantially all paths of transverse flow through the metal wire fabric regardless of the angle of projection toward the working surface or surfaces of the fabric.

More specific advantages and other details of the invention are set forth in further description related to the accompanying drawings, in which:

FIG. 1 is a schematic illustration of one embodiment of apparatus which can be used for shaping round wire;

FIG. 2 shows the cross-sectional configuration of a shaped wire used for forming metal wire spirals in accordance with the invention;

FIG. 3 shows a cross-sectional configuration of a spiral used in the present invention, such cross-sectional configuration being the projection of an individual loop (complete helical revolution) of a spiral on a plane perpendicular to the winding axis of the spiral;

FIG. 4 is a side view of a winding mandrel for use in the present invention;

FIG. 5 is an enlarged cross-sectional view taken along the lines 5—5 of the mandrel of FIG. 4;

FIG. 6 is a partial view at the juncture of two next adjacent spirals joined by a connecting rod in accordance with the present invention, such view being in the plane of projection referred to in describing FIG. 3;

Figure 7:
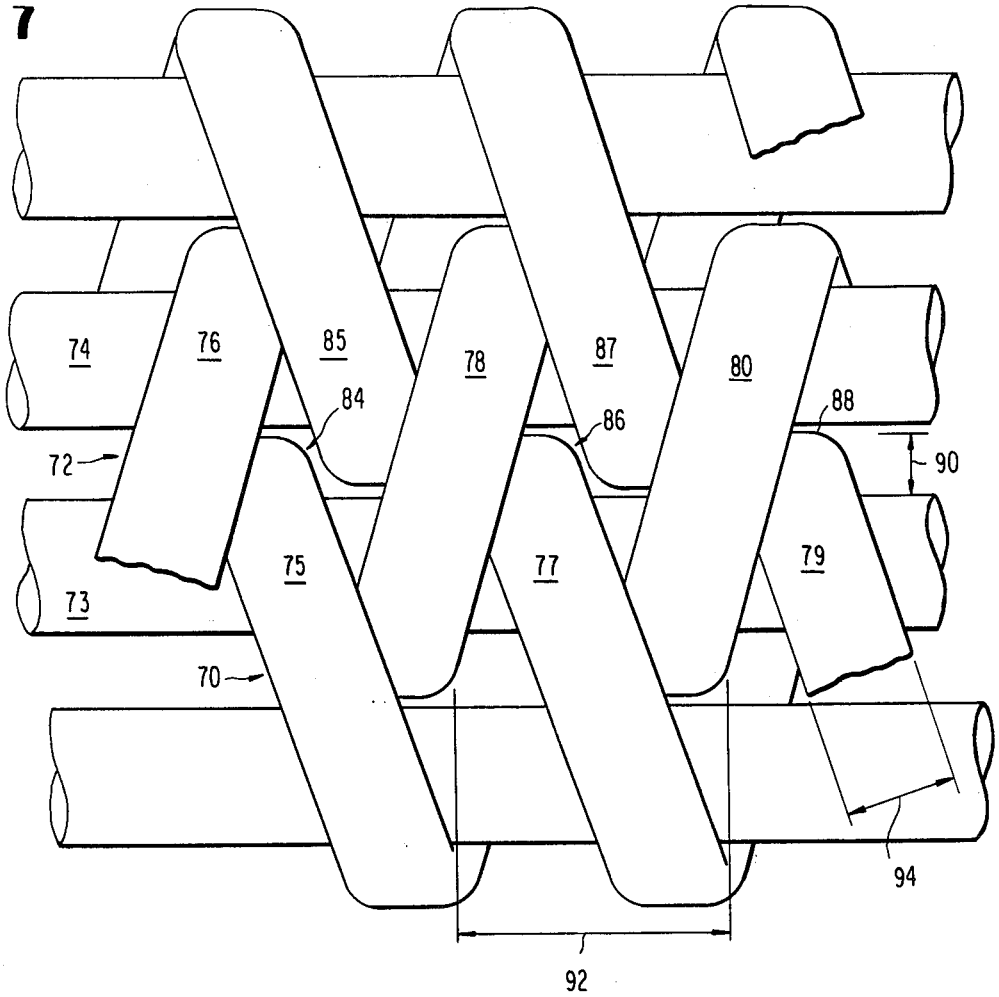
FIG. 7 is a top plan view, with portions cut away, of metal wire fabric in accordance with the present invention in which the shaped wire of FIG. 1 is used in the fabrication of the spirals.

In the present invention, elongated left-hand and right-hand helically-wound spirals are fabricated and placed in next adjacent relationship with their winding axes parallel. Individual loop portions of each spiral interfit within individual loops of the next adjacent oppositely-wound spiral. Longitudinally overlapping portions of next adjacent pairs of spirals are joined by a connector rod. Repeating such assembly with additional helically-wound spirals and connecting rods establishes a longitudinal direction for the fabric which, when the wire fabric is used as a conveyor belt, is the longitudinal direction of movement of the belt. Pivotal relative movement between spirals is provided about each connecting rod which facilitates deflection of the fabric from the path of such longitudinal movement to enable flexing about guide, support, or drive rolls. The longitudinal stability of the elongated connector rods provides desired inflexibility of the fabric in the lateral direction.

In accordance with the present invention, shaped metal wire is provided for helically winding. At least two diametrically opposite planar surfaces are provided. Shaping of the wire is, preferably, carried out as part of the belt manufacturing process by rolling round wire shortly prior to helical winding. However, otherwise pre-shaped wire can be utilized.

Referring to FIGS. 1 and 2, round metal wire 10 of selected diameter 12 is rolled between rolls 14, 16 to provide flattened wire 18 with diametrically opposite planar surfaces 20, 21.

During roll flattening, the original dimension 12 of round steel wires conventionally used in the manufacture of metal wire fabrics is reduced to a rolled cross-sectional dimension 22. The remaining cross-sectional dimension 24 (90° from the reduction axis) is generally expanded. About twenty percent (20%) reduction and about ten percent (10%) expansion are typical values when soft annealed steel or soft annealed stainless steel is rolled as shown. With other metals or metallurgical conditions, the relationship of reduction and expansion can vary. Typically, the reduction in one plane is between about 20% and 30% and the expansion in a plane at 90° to the original is in excess of about 5% and can extend to about 12.5%.

The shaped metal wire 18 is helically wound about a mandrel selected to give the desired spiral cross-sectional configuration using a winding method similar in principle to that described in the U.S. patent to Ploss U.S. Pat. No. 3,308,856. In practice of the present invention, wire 18 is wound with a planar surface in surface contact with the external working surface of the mandrel.

Referring to FIG. 3, when flattened metal wire 18 is helically wound in accordance with the invention using a mandrel as shown in FIGS. 4 and 5, a generally elliptical cross-sectional configuration 26 is produced. FIG. 3 is an axial view of the "helix" comprising a cross-sectional projection of the spiral, or an individual loop of the spiral, on a plane perpendicular to winding axis 28; this configuration is also seen in a lateral side view of a spiral of the assembled fabric.

Elongated sides 29, 30 of the elliptical configuration of FIG. 3 are spaced, along minor axis 31 of the ellipse, a greater distance from the major axis 32 than portions of such elongated sides near the "bight" ends of the elliptical configuration. Such bight ends 33, 34 are curvilinear in cross-sectional configuration. The elongated sides 29, 30 can have linear portions along their lengths, e.g. at or near minor axis 31 and extending toward rounded bight ends 33, 34. The curvilinear configuration of bight ends 33, 34 is determined during mandrel winding.

The major axis 32 of elliptical cross-sectional configuration 26 is, during assembly, oriented with its major component in the longitudinal direction of the fabric. In a plan view of the assembled metal wire fabric, the elongated sides 29, 30 are slightly angled (at approximately the helical winding angle) to such longitudinal direction.

Mandrel 36 of FIG. 4 has a drive input end 38 and elongated working surface portion 40. Referring to FIG. 5, axis 42 corresponds to minor axis 31 of the elliptical configuration 26 (FIG. 3). The spacing along axis 42 provides an open configuration for a spiral at the mid-point of its elongated sides. During assembly, a portion of the external surface of a loop is received within such open configuration as described later in relation to FIG. 7.

In the preferred embodiment of a mandrel for use in the present invention, both rounded and linear working surfaces are presented. The external surface portions of the mandrel contiguous to the intersection with axis 42 can be linear in cross section as shown at 44, 46 of FIG. 5; or, such centerline portion can be curvilinear in cross section. Axis 48 of mandrel 36 corresponds to major axis 32 of elliptical configuration 26 and, the external curvilinear surfaces 50, 52 of mandrel 36 form bight ends 33, 34 of a spiral loop. Intermediate leg portions of the mandrel work surface, such as 54, between curvilinear surfaces 44 and 50, can be substantially rectilinear in cross-sectional configuration.

Connector rods, in accordance with the present invention, have a curvilinear cross-sectional external surface configuration for confronting internal surfaces at bight ends (33, 34) of a spiral; such rods are non-crimped and without re-entrant surfaces along their lengths.

In the embodiment of FIG. 6, a cylindrical configuration rod mates with bight surfaces of semi-circular configuration within overlapping portions of the internal loops of next adjacent spirals. Radius 56 of cylindrical connecting rod 58 is approximately equal to the internal radius of curvature of circular portion 60 of spiral 62 and, also, is approximately equal to the radius of curvature of circular portion 64 of spiral 66.

The loops of adjacent pairs of helically-wound spirals overlap in the longitudinal direction as shown in FIG. 6; such overlap occurs at leading and trailing longitudinal bight ends of each spiral and, a connecting rod is inserted at each such spiral bight end during assembly (FIG. 7).

The loops of adjacent helical spirals are not interwoven with each other but, rather, the connecting rod, extending laterally of the fabric, is inserted between overlapping portions; this enables pivotal relative movement of next adjacent helically-wound spirals about the connecting rod. However, non-rotational relative movement tending to separate overlapping portions, or increase the amount of overlap, is prevented through use of the teachings of the present invention as considered later in more detailed description of FIGS. 7 and 8.

Referring to FIG. 3, elongated helically-wound spirals are formed with internal loops widened at the minor axis 31 substantially as shown, i.e. with spacing between leg portions 29, 30 contiguous to minor axis 31 being greater than the spacing between the leg portions contiguous to bight ends 33, 34. The loops (individual wire revolutions) of a spiral are distributed uniformly along longitudinal winding axis 28 of each helically-wound spiral.

Helically-wound spirals are fabricated to have a length dimension, measured along the winding axis, at least equal to the desired lateral width of the metal wire fabric to be assembled. The connecting rods provided are of at least the same length.

The pitch of the helical windings is predetermined along with the connector rod and spiral wire cross-sectional dimensions such that at least a portion of each external bight surface of an individual spiral loop (excluding only exposed bight portions at lateral ends of an assembled belt) is received within the widened minor axis portion of an internal loop of a next adjacent helically-wound spiral.

The cross-sectional dimensions for helically-wound spirals are the same, as are the cross-sectional dimensions of the connecting rods, throughout the area where the desired barrier effect is to be provided in the assembled fabric.

The cross-sectional dimensions of flattened wire 18 and the connecting rods are predetermined, along with the number of spirals per unit axial length (pitch) of the helically-wound spirals, to provide a fabric which is substantially impervious to transverse passage while providing desired flexibility and other characteristics. By the dimensional relationship taught and use of the described elliptical spiral shape, various sizes and weights of fabric can be manufactured excluding, for practical purposes, transverse passages for solids without relying on selection of small gage wire or compound weaving to reduce transverse openings in a metal wire fabric.

The described relationship results in at least a portion of the external bight at each end of each spiral loop (excluding exposed portions of the loops at lateral ends of an assembled fabric) extending into the widened minor axis portion of an internal loop of a next adjacent helically-wound spiral. This is best seen in FIG. 7 which shows portions of right-hand helically-wound wire 70 and left-hand helically wound wire 72 in assembled relation to connecting rods 73 and 74.

The bight end portions of the right-hand wound loops of spiral 70 extend into the internal left-hand wound loops of next adjacent spiral 72 with connecting rod 73 inserted laterally forming a pivotal juncture for such spirals.

As shown, a bight end surface portion at the upper end of loop 75 of spiral 70 is within the internal loop of loop 76 of spiral 72; and, correspondingly, 77 within 78, and 79 within 80. The connecting rod 73, and rod 74 for the next assembly, occupy portions of the major axis dimension of a loop not otherwise filled by wire of the flattened helically-wound spiral in the completed assembly, with only nominal clearance (such as 0.005" between abutting surfaces) remaining.

Clearances between abutting wire surfaces of right-hand wound loops 75, 85 and portions of connector rods 73, 74 are indicated at 84; such clearances between right-hand loop 77, 87 and connector rods 73, 74 are designated as 86. The clearance between a flattened external bight surface and a connector rod is indicated at 88. Such clearance spaces are shown dimensionally exaggerated in FIG. 7 so as to be visibly discernible in the drawings. In practice, such clearance spaces are not readily discernible unless the belt is held up to a light source. Such clearances comprise the only means for transverse passage after assembly.

With controlled manufacture, clearances of about 0.005" are practical, and smaller clearances can be accomplished. Considering commercial end uses for wire fabric, substantially any solid particulate material can be handled achieving substantially the same barrier effect as a solid surface.

Passage for gases is also limited to such clearance space by the configuration presented. The gas barrier properties of metal wire fabric manufactured in accordance with the present invention were compared, by a manometer testing procedure, to that of the compound balance weave of the prior art which was previously thought to be the tightest weave available. It is estimated from such test procedures that a metal wire fabric of the present invention, with spiral wire flattened on two surfaces only, can provide up to four (4) times more effective air blockage than a three-spiral compound balance weave. Such result was obtained by comparing wire belt CB3-28-72-14, in which "CB3" indicates three-spiral compound balance weave, "28" designates the number of loops per foot of width in each spiral for a total of "84" in the CB3; "72" designates the number of rods per foot of length, and "14" designates the wire gage with an embodiment of the present invention designated 60-60-14 with "60" loops per designated foot of width, "60" rods per foot of length, and "14" gage wire.

Cross-sectional dimensions of the connecting rods and the flattened helically-wound wire are predeterminedly related to the major axis dimension of the internal loop in achieving the desired barrier effect of the present invention and other distinguishing characteristics. Note in FIG. 7 that the major axis dimension of an internal loop of a spiral is equal in length to the sum of the transverse cross-sectional dimensions of two connecting rods and the transverse cross-sectional dimension between planar surfaces (indicated at 90 in FIG. 7) of one helically-wound wire, plus longitudinal clearances allowed between external abutting flat surfaces of the spirals and connector rods.

The pitch of the helically-wound spiral is related to the cross-sectional dimension between the remaining diametrically opposed surfaces (at 90° to the axis of the planar surfaces 21, 22 of the flattened wire 18 of FIG. 2). In the embodiment shown in FIG. 7, such pitch (length of a single revolution measured along the winding axis) indicated at 92 is approximately two and one-half (2.5) times the expanded cross-sectional dimension (measured laterally as indicated at 94 in FIG. 7) of the flattened helically-wound wire. In practice, this ratio has a range with a minimum of two (2) and extends to about three (3) dependent on what portion of the bight ends of spiral loops can, using commercially acceptable assembly practice, be inserted into the open central portion of next adjacent oppositely wound loops.

Data for typical embodiments using the shaped wire of FIG. 2 are shown in the following table:

| Spiral Wire | A | B |
|---|---|---|
| Starting gage | #16 | #14 |
| Cross-sectional dimensions: | | |
| Round wire | .062" | .080" |
| Flattened | .049" | .064" |
| (Reduction of round wire diameter) | (20.77%) | (20%) |
| Expanded | .0684" | .0855" |
| (Expansion of round wire diameter) | (10.5%) | (6.9%) |
| Connector rod | | |
| Gage | #13 | #10 |
| Diameter | .092" | .135" |
| Pitch (spiral length along major axis) | .178" | .197" |
| Flexing radius | ⅞" | 1¼" |
| Weight/sq. ft. | 5.25" | 7.92" |

Washburn and Moore steel wire gage (W&M Wire G) numbers are presented in the above table.

Wire sizes for connector rods are selected to be at least equal to or greater than starter round wire sizes for the spirals; in example A above, the connector rod is three gage sizes larger; in example B, it is four size gages larger; in practice, such differences in wire sizes would ordinarily be less than ten gage sizes. The pitch in example A is 2.6 times the expanded cross-sectional dimension of the spiral wire and, in example B, it is 2.3.

The relative pivotal movement of next adjacent pairs of spirals is apparent from FIG. 6. That non-rotational relative movement is eliminated is seen from FIG. 7. The metal wire fabric can neither be expanded nor contracted longitudinally since two rods and a spiral occupy the major axis dimension within the internal loops of the spirals. Relative lateral movement is prevented by the elliptical shape of the spiral with bight ends of the loops inserted in the open central portion of next adjacent oppositely wound loop.

Figure 8:
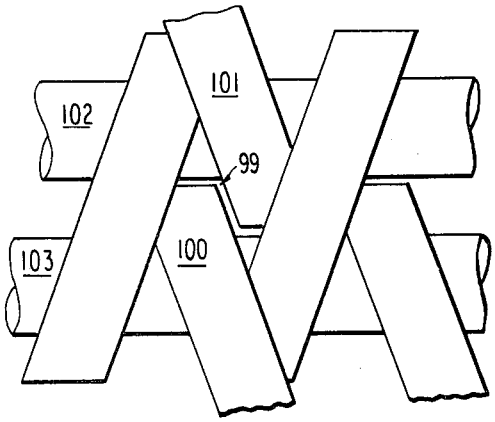
FIG. 8 is a top plan view of a portion of a metal wire fabric in accordance with the invention in which rectangular cross-sectional wire is used in the fabrication of the spirals.

The barrier effect can be increased by use of rectangular cross-sectional wires in the present invention as shown in FIG. 8. The defined clearance space designated as 99 in FIG. 8 corresponds in location to the clearance space designated 84 in FIG. 7; it is seen that the round edge portion of the space 84 of FIG. 7 is eliminated by using wire of rectangular cross section. Space 99 of FIG. 8 is defined by the lateral-direction clearance between external side surfaces of rectangular cross-section wire loops 100, 101 and the longitudinal-direction clearance between the external bight end of loop 100 and connector rod 102 and the longitudinal-direction clearance between loop 101 and connector rod 103.

Problems and disadvantages associated with wear of conventional wire belts have been long recognized in the industry. For example, longitudinal stretching during use results from wear of line contact surfaces between elements of conventional metal wire fabrics, and from other causes. The present invention provides important non-stretch characteristics. The extended surface area of contact provided by the planar wire surface contact combined with the matching curvilinearity of the connecting rods and internal bight surfaces of the spiral loops are significant factors in the favorable non-stretch characteristics obtained both in break-in and in reducing wear during usage.

While mandrels of described cross-sectional configuration are preferred for consistently producing a desired elliptical configuration of spiral loops, acceptable elliptical configurations can be accomplished by other winding techniques, not part of the present invention, which would enable use of mandrels shaped other than as described in relation to FIG. 5.

Specific combinations and data on wire and rod gages, configurations and material, have been set forth in describing specific embodiments of the invention. In the light of the above description other combinations which rely on the principles of the invention taught can be arrived at by those skilled in the art; therefore, in determining the scope of the present invention, reference should be made to the appended claims.

I claim:

1. Barrier-type metal wire fabric comprising a plurality of metal wire helically-wound spirals and connector rod means of predetermined gage and configuration assembled to establish a longitudinal direction for such fabric, such spirals being formed from elongated metal wire having a predetermined transverse cross-sectional configuration with at least two diametrically opposed planar surfaces, such spirals including left-hand wound spirals and right-hand wound spirals, each such helically-wound spiral being elongated and having a centrally located winding axis with individual helical loops uniformly distributed along such winding axis, such individual helical loops having a substantially elliptical configuration when projected onto a plane in transversely perpendicular relationship to such winding axis, such elliptical configuration defining a major axis and a minor axis with the major axis being oriented in the longitudinal direction of assembled fabric, an individual loop having an internal surface and external surface defining longitudinally leading and trailing bight end portions of its curvilinear configuration, such bight end portions being connected by intermediate elongated leg portions disposed generally longitudinally in assembled fabric, such internal loop configuration defining an enlarged cantrally-located opening with spacing between such elongated leg portions being greater contiguous to such minor axis than contiguous to such bight ends, such internal loop surface being defined by one of the at least two diametrically opposed planar surfaces of such helically-wound wire with such exterior loop surface being defined by the remaining planar surface of the two diametrically opposed surfaces of such helically-wound wire, such connector rod means including a plurality of metal wire connector rods, such connector rods being elongated and having a length dimension at least equal to the lateral dimension of metal wire fabric as assembled, each such connector rod presenting a predetermined curvilinear cross-sectional exterior surface configuration, the plurality of helically-wound spirals being disposed with their winding axes substantially parallel and extending in the lateral direction of assembled metal wire fabric and with internal loop portions of next adjacent pairs of helically-wound spirals overlapping in the longitudinal direction of assembled wire fabric, such next adjacent pairs of overlapping spirals being oppositely wound such that left-hand spiral portions overlap with right-hand spiral portions, such adjacent pairs of spirals being free of interlocking weaving of overlapping portions with at least a portion of the external loop bight end surface of one spiral being disposed within the internal loop of its next adjacent oppositely wound spiral at a location contiguous to the minor axis of such latter internal loop, the connector rod means being disposed to extend in the lateral direction of the metal wire fabric as assembled with a connector rod extending laterally through overlapping portions of internal loop surfaces of next adjacent pairs of helically-wound spirals, such connector rod means providing for pivotal relative movement of next adjacent pairs of spirals about a connector rod while substantially eliminating non-rotational relative movement between such next adjacent pairs of helically-wound spirals, the helically-wound spirals and connector rod means as assembled establishing a metal wire fabric of extended surface area which is substantially free of open passages in a direction transverse of such surface area.

2. The metal wire fabric of claim 1 in which the cross-sectional dimension between such at least two diametrically opposed planar surfaces of the helically-wound wires is less than the cross-sectional dimension at 90° thereto between the remaining two diametrically opposed surfaces.

3. The metal wire fabric of claim 2 in which such remaining diametrically opposed surfaces are curvilinear in cross-sectional configuration.

4. The metal wire fabric of claim 1 in which the cross-sectional configuration of the metal wire of such spirals presents two pairs of diametrically opposed planar surfaces so as to be substantially rectangular in cross-sectional configuration.

5. The metal wire fabric of claim 1 in which such connector rods have an external surface of cylindrical configuration.

6. The metal wire fabric of claim 5 in which such connector rod external surface is non-crimped and free of reentrant surfaces along its length.

7. The metal wire fabric of claim 1 in which the cross-sectional dimensions of each of the plurality of helically-wound spirals are substantially the same, the connector rods have a cylindrical configuration with the thickness gage of each of the plurality of connector rods being substantialy the same, and in which the thickness gage of a connector rod is at least equal to the cross-sectional dimension between planar surfaces of metal wire of such helically-wound spirals.

8. The metal wire fabric of claims 5, 6, or 7 in which the internal loop bight surface at longitudinally leading and trailing ends of internal loops in each spiral defines a contact surface forming part of a circle having a radius of curvature substantially equal to the radius of curvature of the cylindrical cross-sectional configuration of the exterior surface of the connector rods.

9. The metal wire fabric of claim 2 in which such diametrically opposed planar surfaces of the metal wire of such helically-wound spirals are formed by flattening diametrically opposed surfaces of selected gage starter wire of circular cross-section, and in which such connector rods are circular in cross section with a gage at least equal to the gage of such starter wire for the helically-wound spirals.

10. The metal wire fabric of claim 7 in which the pitch of the helically-wound wires is in a range which is no less than two and no greater than about three times the cross-sectional dimension between the two remaining diametrically opposed surfaces.

11. The metal wire fabric of claim 7 in which the major axis dimension of internal loops of the helically-wound spirals as projected onto a plane in perpendicularly transverse relationship to the winding axis is substantially equal to the sum of two connector rod diameters plus the cross-sectional dimension between the diametrically opposed planar surfaces of the helically-wound wire.

* * * * *